United States Patent [19]

Stone et al.

[11] 4,063,674

[45] Dec. 20, 1977

[54] METHOD OF MAKING A WOUND MUSICAL INSTRUMENT STRING

[75] Inventors: W. Norman Stone, New Brunswick, N.J.; Alfred S. Falcone, East Hartford, Conn.

[73] Assignee: National Musical String Company, New Brunswick, N.J.

[21] Appl. No.: 699,708

[22] Filed: June 25, 1976

[51] Int. Cl.[2] ..... G10D 3/10

[52] U.S. Cl. ..... 228/173 E; 228/231; 84/297 S

[58] Field of Search ..... 84/297S; 57/161, 166; 228/173, 231; 148/11.5 Q, 12 B, 127

[56] References Cited

U.S. PATENT DOCUMENTS

| | | | |
|---|---|---|---|
| 1,468,323 | 9/1923 | Olson | 84/297 S |
| 2,745,658 | 5/1956 | Gaskins | 148/12 B X |
| 3,217,838 | 11/1965 | Peterson et al. | 57/166 X |
| 3,605,544 | 9/1971 | Kondo | 84/297 S |
| 3,906,711 | 9/1975 | Nakamura et al. | 57/166 X |

*Primary Examiner*—Donald G. Kelly
*Assistant Examiner*—K. J. Ramsey
*Attorney, Agent, or Firm*—McCormick, Paulding & Huber

[57] ABSTRACT

A method for making a wound musical instrument string having improved tone quality and life involves the winding of a cover wire onto a core wire followed by a thermal conditioning step in which the string is heated to an elevated temperature for a significant period of time.

9 Claims, No Drawings

METHOD OF MAKING A WOUND MUSICAL INSTRUMENT STRING

BACKGROUND OF THE INVENTION

This invention relates to strings for musical instruments, and deals more particularly with a method for making an improved string of the wound type, that is, of the type wherein a cover wire is helically wound around a core wire throughout the active length of the string.

Up to the present time, wound musical instrument strings, such as wound strings for guitars, have been found to have a limited useful life insofar as after the strings are installed in an instrument, tuned to their desired pitch and then played, the tone or sound produced by the string gradually diminishes in brilliance, with increases in played time, until reaching a "dead" or "flat" quality no longer acceptable to skilled musicians. The present invention relates to a process for making a wound musical instrument string which has been discovered to result in a string having less tendency, compared with previously known wound strings, to lose the brilliance of its tone as it is played and to, therefore, have a longer useful life than presently known strings.

The process with which this invention is concerned has also been found to result in a wound musical instrument string having improved tone and other qualities in comparison with previously known strings of a generally similar type.

SUMMARY OF THE INVENTION

The invention resides in a method for making or improving a musical instrument string of the wound type, and deals more particularly with a method wherein following the wrapping of the cover wire onto a core wire, the string is thermally conditioned by heating it to an elevated temperature for a substantial period of time. The elevated temperature and the associated period of time are such, with regard to the material of the cover wire, as to relieve residual stresses in the cover wire caused by the wrapping process.

Further, the invention more specifically (but not necessarily in its broader aspects) resides in the core wire having a lower coefficient of thermal expansion than the cover wire, and in this case the heating step also makes more regular the spacing of the convolutions of the cover wire relative to one another along the length of the core wire.

The core wire may also include a coating of tin or other relatively low melting point material and in this case another particular aspect of the invention resides in the elevated temperature to which the string is heated being a temperature near or greater than the melting temperature of the coating with the result that a soldering effect is obtained which tends to create a metallurgical bond between the cover wire and the core wire.

DETAILED DESCRIPTION OF THE PREFERRED EMBODIMENT

In accordance with the method of this invention, a wound musical instrument string is first partially completed in a conventional manner by helically wrapping a metallic cover wire around a metallic core wire at normal room temperatures. The materials of which the two wires are made may vary widely, but to achieve the full benefits of the invention, the cover wire is preferably made of a material having a thermal coefficient of linear expansion greater than that of the material of which the core wire is made. As an example, the core wire may be made of steel or stainless steel, and if made of steel may be nickel plated or tin coated to inhibit rust and corrosion, and the cover wire may be made of brass, copper, bronze, aluminum or steel and may be either bare or plated with silver or other suitable material.

After the production of the partially completed string, it is thereafter completed by subjecting it to a thermal conditioning process involving soaking the string at an elevated temperature for a substantial period of time. The temperature and time period involved are such, as appropriate for the material of the cover wire, as to relieve the residual stresses developed in the cover wire during the wrapping process. After the stress relief has been accomplished, the string is cooled back to room temperature. For example, if the cover wire is made substantially of brass, bronze or copper, the temperature to which the string is heated during the thermal conditioning process may vary from 270° to 480° F. As the temperature is increased, the time period involved may be diminished. At a temperature of 270° F the period of heat soak should be a minimum of 2 hours and for a temperature of 480° F the period of heat soak should be a minimum of 30 minutes. Other cover wire materials may require other degrees of elevated temperature and periods of soak before stress relief is accomplished. If either the cover wire or the core wire is made of a material which tends to tarnish in air at elevated temperatures, the thermal conditioning process is carried out in the absence of air, that is, in a vacuum or in an inert atmosphere such as carbon dioxide or nitrogen, to preclude such tarnishing.

The thermal conditioning process described above has been found to have a very beneficial effect on the wound strings produced thereby. Among other things, it reduces the previous tendency of the cover wires of wound strings to unwind from their wires with increases in playing time and for the strings, therefore, to lose tonal brilliance. That is, it is believed that in previous wound strings residual stresses in the cover wire, produced during the winding or wrapping process, gradually cause the cover wire to unwind from the core wire during usage, with such unwinding having an adverse damping effect causing the tone of the sound produced by the string to acquire a dead or flat quality lacking in brilliance. This unwinding is a process which occurs over a period of time and is accelerated by the vibrational energy from playing the instrument. The thermal conditioning process of this invention relieves the level of residual stresses in the cover wire and thereby renders the cover wire less susceptible to the previous adverse affects of tuning and vibrational energy imparted to the string during playing.

If a wound string having a cover wire with a coefficient of linear thermal expansion greater than that of the core wire is subjected to the thermal conditioning process of this invention, microscopic inspection of the string both before and after the thermal conditioning shows that after the thermal conditioning process the convolutions of the cover wire are more regularly spaced relative to one another along the length of the core wire than they are before the conditioning process. It is believed that this regularizing of the convolution spacing of the cover wire at least contributes to an improved tone quality of the string.

In cases where the core wire is covered with a tin coating, or other coating of a material with a melting point substantially lower than that of the core wire and that of the cover wire, further enhancement of the tone and greater improvement in the life of the string can sometimes be gained by carrying out the thermal conditioning process at a temperature near or above the melting temperature of the coating. In this case, the temperature of the conditioning step causes a soldering effect to occur which creates a bond between the cover wire and the core wire further resisting displacement of the cover wire relative to the core wire with changes in string tension and increases in playing time.

We claim:

1. The method for improving a wound musical instrument string of the type comprising a core wire and a cover wire helically wrapped around said core wire, said method comprising the step of heating said string to an elevated temperature for a substantial amount of time, said elevated temperature being of such degree and said amount of time being of such duration as to relieve residual stresses in said cover wire caused by the wrapping of said cover wire onto said core wire.

2. The method for improving a wound musical instrument string of the type comprising a core wire and a cover wire of greater coefficient of linear expansion than said core wire wrapped around said core wire, said method comprising the step of heating said string to an elevated temperature for a period of time until the convolutions of said cover wire assume a more regular spacing relative to one another along the length of said core wire.

3. The method of making a wound musical instrument string, said method comprising the steps of: providing a core wire, helically wrapping a cover wire at room temperature around said core wire to produce a partially complete string, heating said partially complete string to an elevated temperature for a substantial amount of time as appropriate for the material of said cover wire to relieve residual stresses in said cover wire caused by the wrapping of said cover wire onto said core wire, and thereafter cooling said string to room temperature.

4. The method of making a wound musical instrument string as defined in claim 3 further characterized by said cover wire being made substantially of a material selected from the class consisting of brass, bronze and copper, said elevated temperature being at least 270° F and said amount of time being at least 30 minutes.

5. The method of making a wound musical instrument string as defined in claim 4 further characterized by said elevated temperature being in the range of 270° to 480° F and said heating of said string being maintained for a time period which decreases with increases in the temperature to which the string is heated during such period, said minimum period being 2 hours for a temperature of 270° F and 30 minutes for a temperature of 480° F.

6. The method of making a wound musical instrument string as defined in claim 3 further characterized by said core wire having a body of one material and a coating of a material with a melting point lower than that of said core wire body and lower than that of said cover wire, and said heating step being carried out at an elevated temperature near or above the melting temperature of said coating material.

7. The method of making a wound musical instrument string as defined in claim 6 further characterized by said coating material being tin.

8. The method of making a wound musical instrument string as defined in claim 6 further characterized by said heating step being carried out in the absence of air.

9. The method of making a wound musical instrument string, said method comprising the steps of: providing a core wire, providing a cover wire having a coefficient of linear thermal expansion greater than that of said core wire, helically wrapping said cover wire around said core wire at room temperature to produce a partially complete string, heating said partially complete string to an elevated temperature for a period of time until the convolutions of said cover wire assume a more regular spacing relative to one another along the length of said core wire, and thereafter cooling said string to room temperature.

* * * * *